US009260879B1

(12) United States Patent
Benhacene

(10) Patent No.: US 9,260,879 B1
(45) Date of Patent: Feb. 16, 2016

(54) SWIMMING POOL CHAIR DEVICE

(71) Applicant: Fatma-Zohra Benhacene, Turlock, CA (US)

(72) Inventor: Fatma-Zohra Benhacene, Turlock, CA (US)

( * ) Notice: Subject to any disclaimer, the term of this patent is extended or adjusted under 35 U.S.C. 154(b) by 236 days.

(21) Appl. No.: 13/919,478

(22) Filed: Jun. 17, 2013

(51) Int. Cl.
*E04H 4/14* (2006.01)

(52) U.S. Cl.
CPC ..... *E04H 4/14* (2013.01)

(58) Field of Classification Search
CPC ..... E04H 4/14
USPC ..... 4/496, 572.1, 578.1; 297/229, 219.12, 297/411.28, 451.3
See application file for complete search history.

(56) References Cited

U.S. PATENT DOCUMENTS 3,400,976 A * 9/1968 Messier ..... 297/118
4,837,869 A 6/1989 Simmon
4,903,926 A * 2/1990 McNarry et al. ..... 248/214
5,307,527 A 5/1994 Schober
5,333,322 A 8/1994 Weir
D351,740 S 10/1994 Tesmer
5,857,226 A 1/1999 Sommer
5,860,171 A * 1/1999 Hicks ..... 4/496
6,079,772 A * 6/2000 Green ..... 297/16.1
6,311,343 B1 11/2001 Wisniewski
6,637,045 B1 10/2003 Larsen
8,757,725 B2 * 6/2014 Schneider et al. ..... 297/451.3
8,783,765 B1 * 7/2014 Matus et al. ..... 297/152
2008/0092285 A1 4/2008 Petersen
2011/0049950 A1 * 3/2011 Pereira ..... 297/219.12

* cited by examiner

*Primary Examiner* — Janie Christiansen

(57) ABSTRACT

A swimming pool chair device secures a child in a chair attached to a side wall of a swimming pool. The device includes a frame comprising a seating member, a pair of legs, and a pair of arms. The seating member comprises an upper portion coupled to and extending away from a lower portion. The seating member is configured to receive and support a user. The legs are coupled to and extend downwardly from the lower portion. The arms are coupled to and extend downwardly from the upper portion. Each of a pair of holders has an open top end configured for receiving a bottom end of one of the arms. The holders are configured for coupling to a side wall of a swimming pool. A plurality of straps is coupled to the seating member and comprises a harness configured to retain the user on the seating member.

18 Claims, 5 Drawing Sheets

SWIMMING POOL CHAIR DEVICE

BACKGROUND OF THE DISCLOSURE

Field of the Disclosure

The disclosure relates to chair devices and more particularly pertains to a new chair device for safely securing a child in a chair attached to a side wall of a swimming pool.

SUMMARY OF THE DISCLOSURE

An embodiment of the disclosure meets the needs presented above by generally comprising a frame comprising a seating member, a pair of legs, and a pair of arms. The seating member comprises an upper portion coupled to and extending away from a lower portion. The seating member is configured to receive and support a user. The legs are coupled to and extend downwardly from the lower portion. The arms are coupled to and extend downwardly from the upper portion. Each of a pair of holders has an open top end configured for receiving a bottom end of one of the arms. The holders are configured for coupling to a side wall of a swimming pool. A plurality of straps is coupled to the seating member and comprises a harness configured to retain the user on the seating member.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
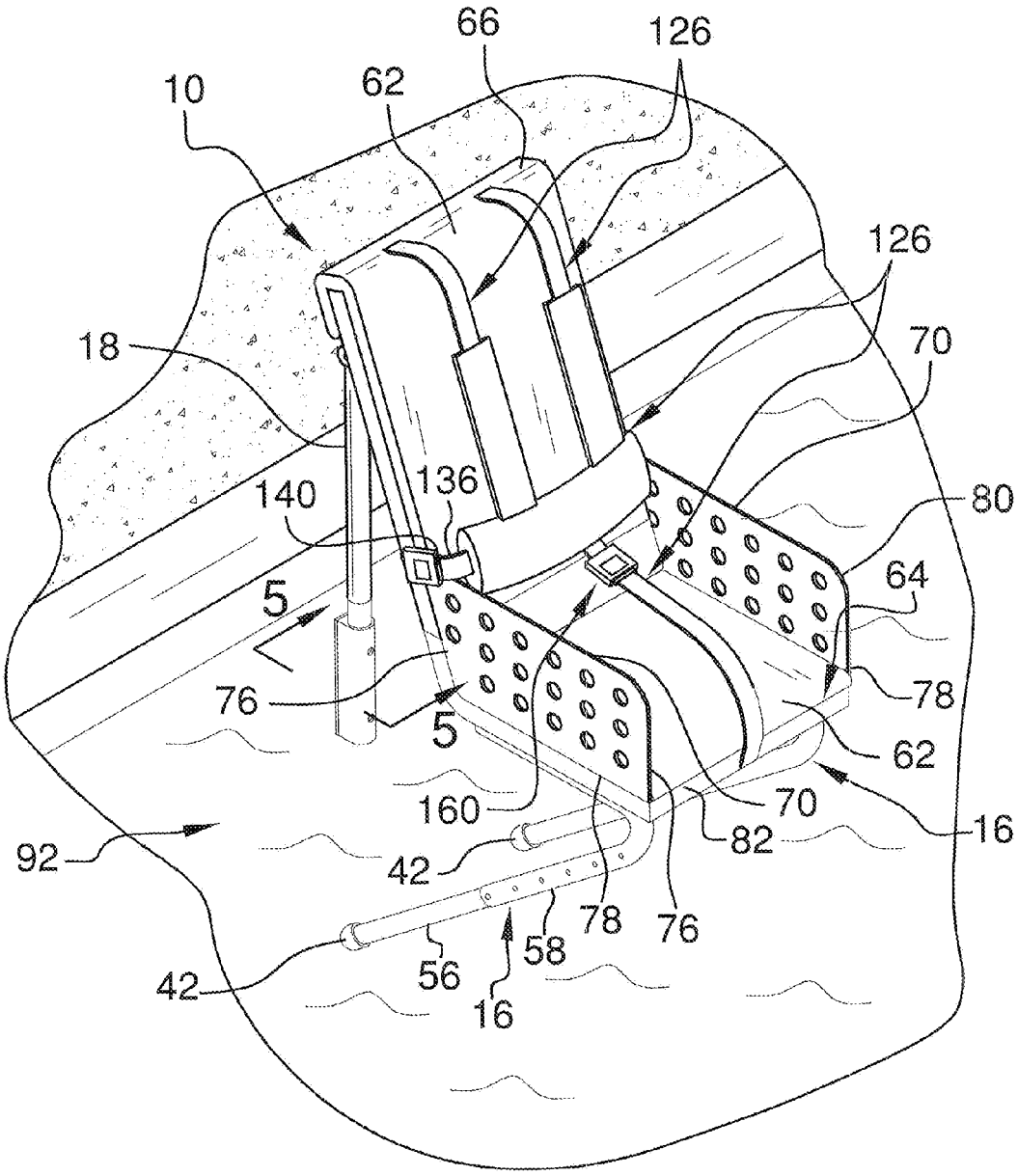
FIG. 1 is a top front side perspective view of a swimming pool chair device according to an embodiment of the disclosure.
Figure 2:
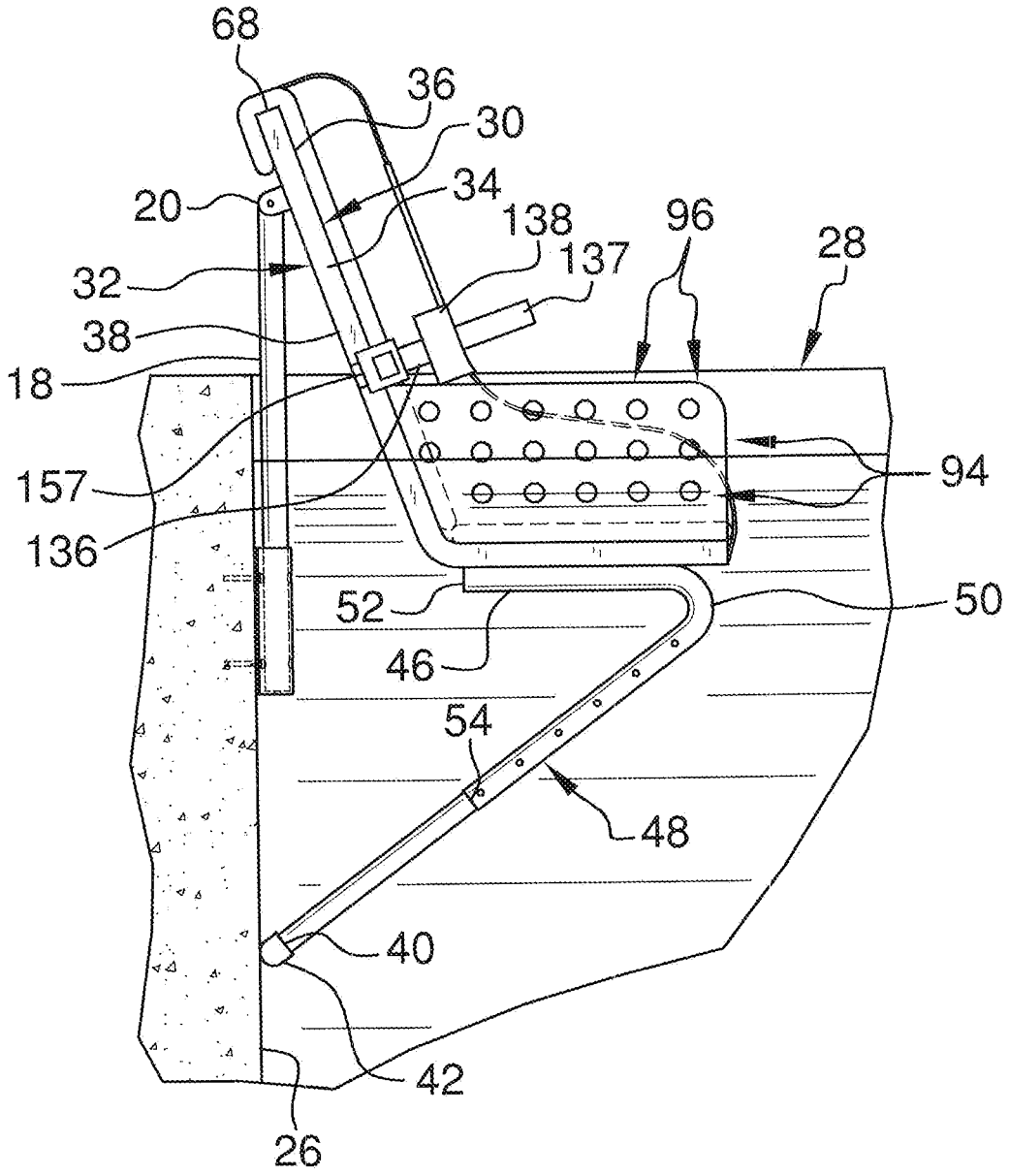
FIG. 2 is a side view of an embodiment of the disclosure in use.
Figure 3:
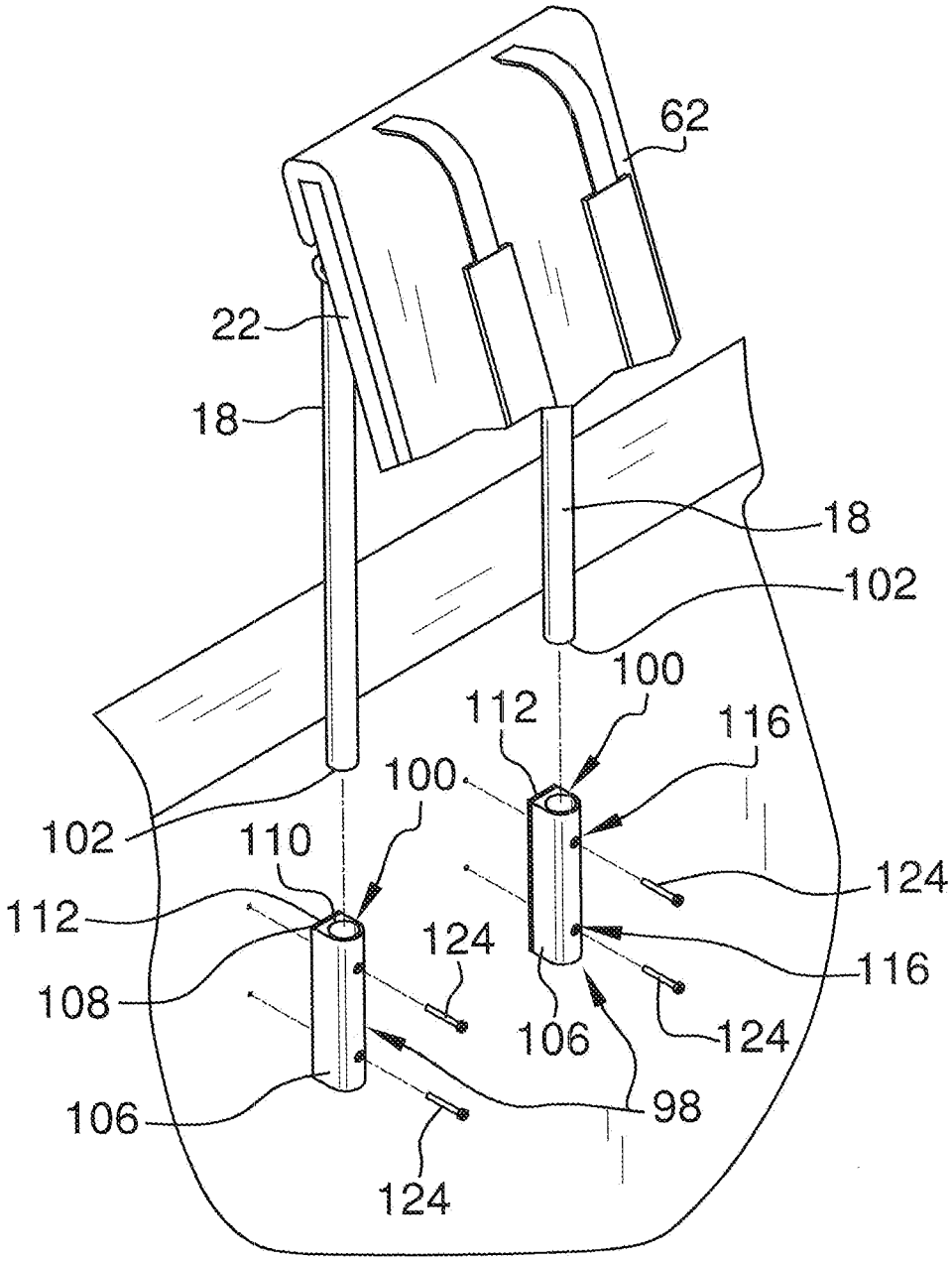
FIG. 3 is a partially-exploded, partial cut-away top front side perspective view of an embodiment of the disclosure.
Figure 4:
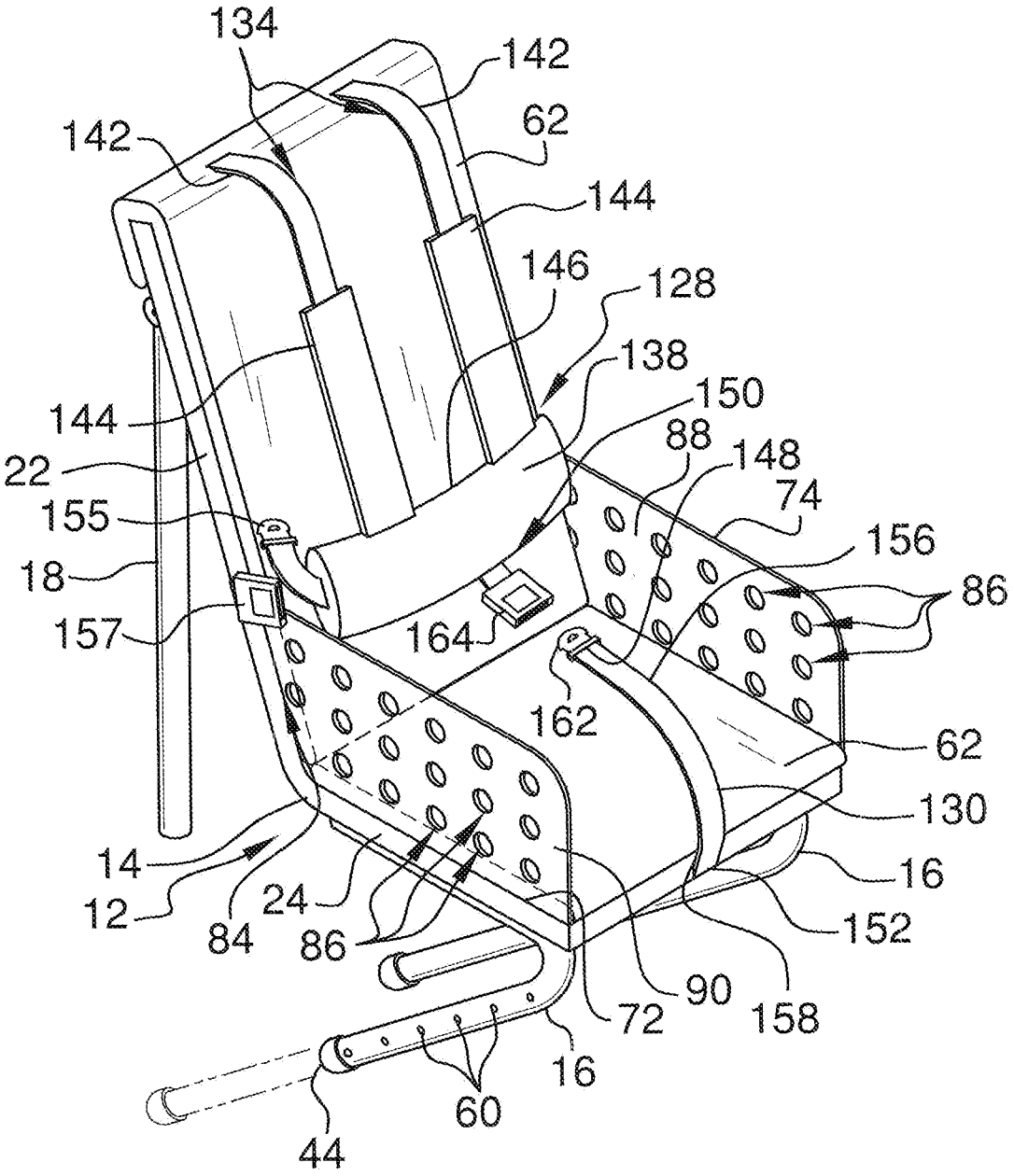
FIG. 4 is a top front side perspective view of an embodiment of the disclosure.
Figure 5:
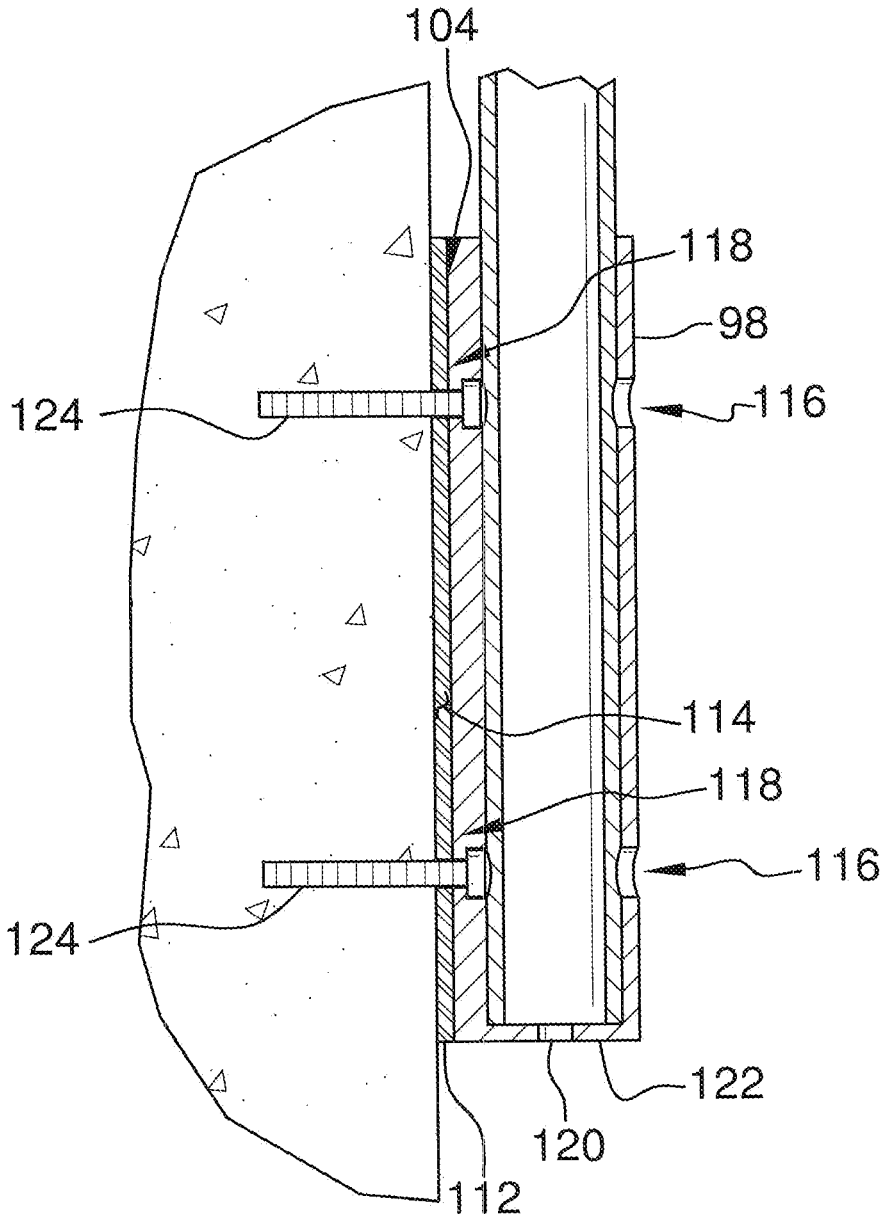
FIG. 5 is a cross-sectional view of an embodiment of the disclosure taken along line 5-5 of FIG. 1.

With reference now to the drawings, and in particular to FIGS. 1 through 5 thereof, a new chair device embodying the principles and concepts of an embodiment of the disclosure and generally designated by the reference numeral 10 will be described.

As best illustrated in FIGS. 1 through 5, the swimming pool chair device 10 generally comprises a frame 12 wherein the frame 12 comprises a seating member 14, a pair of legs 16, a pair of arms 18, and a connection member 20. The frame 12 is preferably made from metal or similar material. The seating member 14 comprises an upper portion 22 and a lower portion 24 and is configured to receive and support a user. The upper portion 22 is coupled to and extends away from the lower portion 24. The upper portion 22 may extend backwardly away from the lower portion 24 such that the upper portion 22 reclines relative to the lower portion 24. The lower portion 24 is configured for positioning perpendicular relative to a side wall 26 of a swimming pool 28. The seating member 14 has a front side 30, a back side 32, and a perimeter wall 34 extending between the front side 30 and back side 32. The perimeter wall 34 has an upper edge 36 and a lower edge 38. The arms 18 are coupled to and extend downwardly from the upper portion 22 of the seating member 14. Each of the arms 18 and the legs 16 is elongated and preferably tubular. The connection member 20 couples each of the arms 18 to the seating member 14. The connection member 20 extends outwardly from the back side 32 of the seating member 14.

The legs 16 are coupled to and extend downwardly from the lower portion 24 of the seating member 14. A distal end 40 of the legs 16 relative to the seating member 14 has an end cap 42 coupled thereto wherein the end cap 42 is configured to abut the side wall 26 of the swimming pool 28. The end cap 42 preferably has an arcuate bottom end 44. Each of the legs 16 has a top portion 46, a bottom portion 48, and an arcuate medial portion 50 extending between the top portion 46 and the bottom portion 48 of the legs 16. The top portion 46 of the legs 16 is coupled to and positioned parallel with respect to the lower portion 24 of the seating member 14. A first end 52 of the top portion 46 of the legs 16 is preferably positioned above a first end 54 of the bottom portion 48 of the legs 16. The legs 16 have a first section 56 and a second section 58. Each of the legs 16 may be telescopic wherein the first section 56 is extendable and retractable into and out of the second section 58. The second section 58 preferably has a plurality of access apertures 60 positioned therein such that a locking member is extendable into a selectable one of the access apertures 60 to permit adjustment of a length of the first section 56 relative to the second section 58.

A cover 62 may be coupled to the seating member 14 and coupled to the front side 30 of the seating member 14. The cover 62 may be comprised of a padded material such that the cover 62 is configured to provide additional support to the user when the user is positioned in the seating member 14. A first edge 64 of the cover 62 is preferably positioned above the upper edge 36 of the seating member 14. A top end 66 of the cover 62 may extend over a top end 68 of the upper portion 22 of the seating member 14 such that the cover 62 is coupled to each of the front side 30 and the back side 32 of the seating member 14. The cover 62 is preferably comprised of a plastic material.

A pair of side walls 70 may be coupled to the seating member 14. Each of the side walls 70 has a bottom edge 72, a top edge 74, and a pair of lateral edges 76 extending between the top 74 and bottom 72 edges of each of an associated one of the side walls 70. The bottom edges 72 of the side walls 70 are coupled to opposite sides 78 of the lower portion 24 of the seating member 14. A first one 80 of the lateral edges 76 of each of the side walls 70 is aligned with a front portion 82 of the perimeter wall 34 of the seating member 14. A second one 84 of the lateral edges 76 of each of the side walls 70 is coupled to the upper edge 36 of the upper portion 22 of the seating member 14. A plurality of holes 86 is positioned in the side walls 70. The holes 86 extend from a front side 88 to a back side 90 of each of the side walls 70 wherein the holes 86 are configured to permit water 92 from the swimming pool 28 to pass therethrough. The holes 86 may be aligned into a plurality of rows 94 and columns 96.

A pair of holders 98 is provided. Each of the holders 98 has an open top end 100 configured for receiving a bottom end 102 of one of the arms 18 therein. Each of the holders 98 has a flat back side 104 and an arcuate perimeter wall 106. The flat back side 104 of the holders 98 is configured for coupling to the side wall 26 of the swimming pool 28. The perimeter wall 106 of each of the holders 98 extends between a first end 108 and a second end 110 of the back side 104 of each of the holders 98. Each of the holders 98 is preferably made of metal or similar material. A pair of pads 112 is preferably provided. Each of the pads 112 is coupled to the back side 104 of an associated one of the holders 98. The pads 112 are preferably comprised of a resiliently compressible material 114, such as rubber or the like.

A front pair of access openings 116 and a back pair of access openings 118 is positioned in each of the holders 98. The front pair of access openings 116 is positioned in the perimeter wall 106 of an associated one of the holders 98 opposite the back side 104 of the associated one of the holders 98. The back pair of access openings 118 is positioned in the back side 104 of the associated one of the holders 98. The front pair of access openings 116 is spaced and vertically aligned with the back pair of access openings 118. A draining aperture 120 may be positioned in each of the holders 98. The draining apertures 120 are positioned on a bottom end 122 of the perimeter wall 106 of each of the holders 98. A plurality of fasteners 124 is removably coupled to the holders 98. Each of the fasteners 124 is extendable through one of the access openings 116, 118 wherein the fasteners 124 are configured for coupling the holders 98 to the side wall 26 of the swimming pool 28. The fasteners may comprise conventional screws or the like.

A plurality of flexible straps 126 is coupled to the seating member 14 wherein the straps 126 comprise a harness 128 configured to retain the user on the seating member 14. The straps 126 comprise a lower strap 130, a medial strap 132, and a pair of upper straps 134 wherein the upper straps 134 are configured to extend over a collarbone region of a user, the medial strap 132 is configured to extend around a waist of the user, and the lower strap 130 is configured to extend over a crotch region of the user.

The medial strap 132 comprises a first strap portion 136, a second strap portion 137, and a medial strap portion 138 extending between the first strap portion 136 and the second strap portion 137. A coupler 154 is provided and comprises a first coupler portion 155 which may be coupled to a first end 140 of the first strap portion 136 and a second coupler portion 157 coupled to the seating member 14 and positioned adjacent the first strap portion 136. In this manner, the coupler 154 releasably couples the first strap portion 136 to the seating member 14 when the first 155 and second 157 coupler portions are selectively engaged. Alternatively, the coupler 154 may be coupled to the second strap portion 137 and could thus secure the second strap portion 137 to the seating member 14. The coupler 154 may comprise a conventional fastener, such as a buckle, snaps, or the like. The coupler 154 permits adjustment of the straps 126 to accommodate the sizing needs of the user. The coupler 154 is preferably constructed from hard plastic. The medial strap portion 138 preferably has a greater width than the first strap portion 136. The top edge 74 of each of the side walls 70 is positioned proximate the medial strap 132.

Each of the upper straps 134 has a top strap portion 142 and a bottom strap portion 144. Each of the top strap portions 142 is coupled to the cover 62 proximate the top end 68 of the upper portion 22 of the seating member 14. Each of the upper straps 134 is parallel with respect to each other. The top strap portions 142 may have a greater width than the bottom strap portions 144. Each of the bottom strap portions 144 is coupled to a top end 146 of the medial strap portion 138 of the medial strap 132.

A connector 160 is provided and comprises a first connector portion 162 coupled to a first end 148 of the lower strap 130 and a second connector portion 164 coupled to a bottom end 150 of the medial strap portion 138 of the medial strap 132. The lower strap 130 is equally spaced from each of the side walls 70. A second end 152 of the lower strap 130 is coupled to the lower edge 38 of the lower portion 24 of the seating member 14. The lower strap 130 may have the same width as the first strap portion 136 of the medial strap 132 as well as the top strap portion 142 of each of the upper straps 134. The connector 160 may comprise a conventional fastener, such as a buckle, snaps, or the like. The coupler 154 permits adjustment of the straps 126 to accommodate the sizing needs of the user. The connector 160 is preferably constructed from hard plastic.

The device 10 may have a height between approximately 50.0 centimeters and 75.0 centimeters, a length between approximately 30.0 centimeters and 60.0 centimeters, and a width between approximately 15.0 centimeters and 25.0 centimeters.

In use, as stated above and shown in the Figures, the holders 98 are coupled to a side wall 26 of the swimming pool 28 using fasteners 124. The arms 18 are then inserted into each of the holders 98, and the legs 16 are extended outwardly until the end cap 42 abuts the side wall 26 of the pool 28. The cover 62 is positioned over the seating member 14 and the user is then fastened into the seating member 14 using both the harness 128 and the coupler 154. Thus, the user is securely retained within and supported upon the seating member 14 while also being near the water 92 of the pool 28. In this manner, the lower body of an infant may come into contact with the water 92 while the infant's upper body is securely positioned above a top surface of the water 92.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A swimming pool chair device configured for attaching to a side wall of a swimming pool, said device comprising:

a frame wherein said frame comprises a seating member configured to receive and support a user, said seating member comprising an upper portion and a lower portion, said upper portion being coupled to and extending away from said lower portion, a pair of legs coupled to and extending downwardly from said lower portion of said seating member, said legs having a first section and a second section, each of said legs being telescopic wherein said first section is extendable and retractable into and out of said second section, said second section having a plurality of access apertures positioned therein such that a locking member is extendable into a selectable one of said access apertures to permit adjustment of a length of said first section relative to said second section, each second section of said legs having a top portion, a bottom portion, and an arcuate medial portion extending between said top portion and said bottom portion of said second section, said top portion of said second section being coupled to and positioned parallel with respect to said lower portion of said seating member, a first end of said top portion of said second section being positioned above a first end of said bottom portion of said second section, and a pair of arms coupled to and extending downwardly from said upper portion of said seating member, each of said arms being pivotable relative to said upper portion of said seating member;

a pair of holders, each of said holders having an open top end configured for receiving a bottom end of one of said arms therein, each of said holders having a flat back side wherein said holders are configured for coupling to a vertical side wall of a swimming pool; and a plurality of straps coupled to said seating member wherein said straps comprise a harness configured to retain the user on said seating member.

2. The device of claim 1, further comprising an end cap being coupled to a distal end of said legs relative to said seating member wherein an arcuate bottom end of said end cap is configured to abut the side wall of the swimming pool.

3. The device of claim 1, further comprising each of said holders having an arcuate perimeter wall, said perimeter wall of each of said holders extending between a first end and a second end of said back side of each of said holders.

4. The device of claim 3, further comprising a draining aperture positioned in each of said holders, said draining apertures being positioned on a bottom end of said perimeter wall of each of said holders.

5. The device of claim 3, further comprising a plurality of fasteners removably coupled to said holders.

6. The device of claim 5, further comprising:

a front pair and a back pair of access openings positioned in each of said holders, said front pair of access openings being positioned in said perimeter wall of an associated one of said holders opposite said back side of said associated one of said holders, said back pair of access openings being positioned in said back side of said associated one of said holders, said front pair of access openings being spaced and vertically aligned with said back pair of access openings; and each of said fasteners being extendable through one of said front pair and back pair of access openings wherein said fasteners are configured for coupling said holders to the side wall of the swimming pool.

7. The device of claim 6, further comprising a pair of pads, each of said pads being coupled to said back side of an associated one of said holders, said pads being comprised of a resiliently compressible material.

8. The device of claim 1, further comprising a pair of side walls coupled to said seating member, each of said side walls having a bottom edge, a top edge, and a pair of lateral edges extending between said top and bottom edges of each of an associated one of said side walls, said bottom edge of said side walls being coupled to opposite sides of said lower portion of said seating member, a first one of said lateral edges of each of said side walls being aligned with a front portion of a perimeter wall of said seating member, a second one of said lateral edges of each of said side walls being coupled to an upper edge of said upper portion of said seating member.

9. The device of claim 8, further comprising a plurality of holes positioned in said side walls, said holes extending from a front side to a back side of each of said side walls wherein said holes are configured to permit water from the swimming pool to pass therethrough, said holes being aligned into a plurality of rows and columns.

10. The device of claim 1, further comprising:

said seating member having a front side, a back side, and a perimeter wall extending between said front side and said back side, said perimeter wall having an upper edge and a lower edge; and a cover coupled to said seating member, said cover being coupled to said front side of said seating member, said cover being comprised of a padded material such that said cover is configured to provide additional support to the user when the user is positioned in said seating member, a first edge of said cover being positioned above said upper edge of said seating member, a top end of said cover extending over a top end of said upper portion of said seating member such that said cover is coupled to each of said front side and said back side of said seating member.

11. The device of claim 1, further comprising said upper portion of said seating member extending backwardly away from said lower portion of said seating member such that said upper portion reclines relative to said lower portion, said lower portion being configured for positioning perpendicular relative to the side wall of the swimming pool.

12. The device of claim 8, further comprising said straps comprising a lower strap, a medial strap, and a pair of upper straps wherein said upper straps are configured to extend over a collarbone region of a user, said medial strap is configured to extend around a waist of the user, and said lower strap is configured to extend over a crotch region of the user.

13. The device of claim 12, further comprising said medial strap comprising a first strap portion, a second strap portion, and a medial strap portion extending between said first and second strap portions, said medial strap portion having a greater width than said first strap portion, said top edge of each of said side walls being positioned proximate said medial strap.

14. The device of claim 13, further comprising each of said upper straps having a top strap portion and a bottom strap portion, each of said top strap portions being coupled to a cover proximate a top end of said upper portion of said seating member, each of said upper straps being parallel with respect to each other, said top strap portions having a greater width than said bottom strap portions, each of said bottom strap portions being coupled to a top end of said medial strap portion of said medial strap.

15. The device of claim 14, further comprising a second end of said lower strap being coupled to a lower edge of said lower portion of said seating member, said lower strap having the same width as said first strap portion of said medial strap and said top strap portion of each of said upper straps.

16. The device of claim 15, further comprising:

a coupler having a first coupler portion coupled to a first end of said first strap portion and a second coupler portion coupled to said seating member and positioned adjacent said first strap portion, said coupler releasably coupling said first strap portion to said seating member when said first and second coupler portions are selectively engaged; and a connector having a first connector portion coupled to a first end of said lower strap and a second connector portion coupled to a bottom end of said medial strap portion of said medial strap, said connector releasably coupling said lower strap to said medial strap when said first and second connector portions are selectively engaged.

17. The device of claim 16, further comprising said coupler comprising a buckle configured to permit adjustability of a length of said straps to accommodate sizing needs of the user when the user is positioned in said seating member.

18. A swimming pool chair device configured for attaching to a side wall of a swimming pool, said device comprising:

a frame wherein said frame comprises a seating member configured to receive and support a user, said seating member comprising an upper portion and a lower portion, said upper portion being coupled to and extending away from said lower portion, said upper portion extending backwardly away from said lower portion such that said upper portion reclines relative to said lower portion, said lower portion being configured for positioning perpendicular relative to a side wall of a swimming pool, said seating member having a front side, a back side, and a perimeter wall extending between said front side and said back side, said perimeter wall having an upper edge and a lower edge, a pair of legs coupled to and extending downwardly from said lower portion of said seating member, said legs having a first section and a second section, each of said legs being telescopic wherein said first section is extendable and retractable into and out of said second section, said second section having a plurality of access apertures positioned therein such that a locking member is extendable into a selectable one of said access apertures to permit adjustment of a length of said first section relative to said second section, each second section of said legs having a top portion, a bottom portion, and an arcuate medial portion extending between said top portion and said bottom portion of said second section, said top portion of said second section being coupled to and positioned parallel with respect to said lower portion of said seating member, a first end of said top portion of said second section being positioned above a first end of said bottom portion of said second section, a pair of arms coupled to and extending downwardly from said upper portion of said seating member, each of said arms being pivotable relative to said upper portion of said seating member, each of said arms and said legs being elongated and tubular, and a respective connection member coupling a top end of each of said arms to said seating member, said top end of each of said arms being pivotable relative to said connection member, said connection member extending outwardly from said back side of said seating member;

an end cap being coupled to a distal end of said legs relative to said seating member wherein said end cap is configured to abut the side wall of the swimming pool, said end cap having an arcuate bottom end;

a cover coupled to said seating member, said cover being coupled to said front side of said seating member, said cover being comprised of a padded material such that said cover is configured to provide additional support to the user when the user is positioned in said seating member, a first edge of said cover being positioned above said upper edge of said seating member, a top end of said cover extending over a top end of said upper portion of said seating member such that said cover is coupled to each of said front side and said back side of said seating member;

a pair of side walls coupled to said seating member, each of said side walls having a bottom edge, a top edge, and a pair of lateral edges extending between said top and bottom edges of each of an associated one of said side walls, said bottom edge of said side walls being coupled to opposite sides of said lower portion of said seating member, a first one of said lateral edges of each of said side walls being aligned with a front portion of said perimeter wall of said seating member, a second one of said lateral edges of each of said side walls being coupled to said upper edge of said upper portion of said seating member;

a plurality of holes positioned in said side walls, said holes extending from a front side to a back side of each of said side walls wherein said holes are configured to permit water from the swimming pool to pass therethrough, said holes being aligned into a plurality of rows and columns;

a pair of holders, each of said holders having an open top end configured for receiving a bottom end of one of said arms therein, each of said holders having a flat back side and an arcuate perimeter wall, said flat back side of said holders being configured for coupling to the side wall of the swimming pool, said perimeter wall of each of said holders extending between a first end and a second end of said back side of each of said holders;

a front pair and a back pair of access openings positioned in each of said holders, said front pair of access openings being positioned in said perimeter wall of an associated one of said holders opposite said back side of said associated one of said holders, said back pair of access openings being positioned in said back side of said associated one of said holders, said front pair of access openings being spaced and vertically aligned with said back pair of access openings;

a draining aperture positioned in each of said holders, said draining apertures being positioned on a bottom end of said perimeter wall of each of said holders;

a pair of pads, each of said pads being coupled to said back side of an associated one of said holders, said pads being comprised of a resiliently compressible material;

a plurality of fasteners removably coupled to said holders, each of said fasteners being extendable through one of said access openings wherein said fasteners are configured for coupling said holders to the side wall of the swimming pool;

a plurality of flexible straps coupled to said seating member wherein said straps comprise a harness configured to retain the user on said seating member, said straps comprising a lower strap, a medial strap, and a pair of upper straps wherein said upper straps are configured to extend over a collarbone region of a user, said medial strap is configured to extend around a waist of the user, and said lower strap is configured to extend over a crotch region of the user, said medial strap comprising a first strap portion, a second strap portion, and a medial strap portion extending between said first strap portion and said second strap portion, said medial strap portion having a greater width than said first strap portion, said top edge of each of said side walls being positioned proximate said medial strap, each of said upper straps having a top strap portion and a bottom strap portion, each of said top strap portions being coupled to said cover proximate said top end of said upper portion of said seating member, each of said upper straps being parallel with respect to each other, said top strap portions having a greater width than said bottom strap portions, each of said bottom strap portions being coupled to a top end of said medial strap portion of said medial strap, said lower strap being equally spaced from each of said side walls, a second end of said lower strap being coupled to said lower edge of said lower portion of said seating member, said lower strap having the same width as said first strap portion of said medial strap and said top strap portion of each of said upper straps;

a coupler having a first coupler portion coupled to a first end of said first strap portion and a second coupler portion coupled to coupled to said seating member adjacent said first strap portion, said coupler releasably coupling said first strap portion to said seating member when said first and second coupler portions are selectively engaged, said coupler comprising a buckle configured to permit adjustability of a length of said straps to accommodate sizing needs of the user when the user is positioned in said seating member; and a connector having a first connector portion coupled to a first end of said lower strap and a second connector portion coupled to a bottom end of said medial strap portion of said medial strap, said connector releasably coupling said lower strap to said medial strap when said first and second connector portions are selectively engaged, said coupler comprising a buckle configured to permit adjustability of a length of said straps to accommodate sizing needs of the user when the user is positioned in said seating member.

* * * * *